US011138961B2

(12) United States Patent
Oba et al.

(10) Patent No.: US 11,138,961 B2
(45) Date of Patent: Oct. 5, 2021

(54) SOUND OUTPUT DEVICE AND NON-TRANSITORY COMPUTER-READABLE STORAGE MEDIUM

(71) Applicant: YAMAHA CORPORATION, Hamamatsu (JP)

(72) Inventors: Yasuhiko Oba, Hamamatsu (JP); Akihiko Komatsu, Hamamatsu (JP); Michiko Tanoue, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 24 days.

(21) Appl. No.: 16/849,392

(22) Filed: Apr. 15, 2020

(65) Prior Publication Data

US 2020/0243056 A1 Jul. 30, 2020

Related U.S. Application Data

(63) Continuation of application No. PCT/JP2017/040062, filed on Nov. 7, 2017.

(51) Int. Cl.
*G10H 1/053* (2006.01)
*G10H 1/34* (2006.01)
*G10H 7/00* (2006.01)

(52) U.S. Cl.
CPC ..... *G10H 1/053* (2013.01); *G10H 1/344* (2013.01); *G10H 7/008* (2013.01); *G10H 2220/221* (2013.01)

(58) Field of Classification Search
CPC ..... G10H 1/053; G10H 1/344; G10H 7/008; G10H 2220/221

(Continued)

(56) References Cited

U.S. PATENT DOCUMENTS 6,362,412 B1 * 3/2002 Ura ..... G10H 1/344 73/488
6,525,255 B1 * 2/2003 Funaki ..... G10H 3/125 84/616

(Continued)

FOREIGN PATENT DOCUMENTS

JP 2003280657 A * 10/2003 ..... G10C 3/18
JP 2003280657 A 10/2003

(Continued)

OTHER PUBLICATIONS

International Search Report issued in Intl. Appln. No. PCT/JP2017/040062 dated Jan. 23, 2018 English translation provided.

(Continued)

*Primary Examiner* — Christina M Schreiber
(74) *Attorney, Agent, or Firm* — Rossi, Kimms & McDowell LLP

(57) ABSTRACT

A sound output device comprising a data storage device storing a first sound signal, a second sound signal, and a third sound signal and a controller including a processor that implements instructions stored in a memory to execute a plurality of tasks, including a sound signal output tasks that reads the first and second sound signals or the first and third sound signals from the data storage device based on first information included in an instruction signal that instructs outputting of sound, the first information designating a magnitude of the sound and outputs the read sound signals.

10 Claims, 8 Drawing Sheets

(58) Field of Classification Search
USPC ..... 84/609
See application file for complete search history.

(56) References Cited

U.S. PATENT DOCUMENTS

| | | | | |
|---|---|---|---|---|
| 6,965,070 | B2 * | 11/2005 | Wenjun | G10C 3/166 84/719 |
| 8,380,331 | B1 * | 2/2013 | Smaragdis | G10L 25/90 700/94 |
| 2006/0212298 | A1 * | 9/2006 | Kemmochi | G10H 5/005 704/278 |
| 2010/0119082 | A1 * | 5/2010 | Kondo | G10L 25/90 381/103 |
| 2012/0137857 | A1 * | 6/2012 | Liu | G10H 5/007 84/622 |
| 2017/0061945 | A1 * | 3/2017 | Okazaki | G10H 7/04 |
| 2020/0005747 | A1 * | 1/2020 | Nishida | G10H 1/46 |
| 2020/0111463 | A1 * | 4/2020 | Sakata | G10H 7/02 |
| 2020/0193949 | A1 * | 6/2020 | Tanoue | G10H 1/0575 |
| 2020/0211519 | A1 * | 7/2020 | Komatsu | G10H 1/346 |
| 2020/0243056 | A1 * | 7/2020 | Oba | G10H 7/008 |
| 2020/0243057 | A1 * | 7/2020 | Oba | G10H 1/346 |
| 2021/0074251 | A1 * | 3/2021 | Oba | G10H 1/346 |
| 2021/0201869 | A1 * | 7/2021 | Oba | G10H 1/0008 |

FOREIGN PATENT DOCUMENTS

| | | | |
|---|---|---|---|
| JP | 2014059534 | A * | 4/2014 |
| JP | 2014059534 | A | 4/2014 |
| JP | 2017191165 | A * | 10/2017 |
| JP | 2017191165 | A | 10/2017 |

OTHER PUBLICATIONS

Written Opinion issued in Intl. Appln. No. PCT/JP2017/040062 dated Jan. 23, 2018.

* cited by examiner

| | waveform to be read out |
|---|---|
| velocity of depression Vel is lower than threshold Vth | first waveform data |
| velocity of depression Vel is equal to or higher than threshold Vth | second waveform data |

FIG. 11

| | lower range | middle range | higher range |
|---|---|---|---|
| velocity of depression Vel is lower than threshold Vth | first waveform data | second waveform data | third waveform data |
| velocity of depression Vel is equal to or higher than threshold Vth | fourth waveform data | fifth waveform data | sixth waveform data |

SOUND OUTPUT DEVICE AND NON-TRANSITORY COMPUTER-READABLE STORAGE MEDIUM

CROSS-REFERENCE TO RELATED APPLICATIONS

This application is a U.S. continuation application filed under 35 U.S.C. § 111(a), of International Application No. PCT/JP2017/040062, filed on Nov. 7, 2017, the disclosures of which are incorporated by reference.

FIELD

The present invention relates to a technology for generating a sound signal.

BACKGROUND

Various attempts have been made to make sounds from an electronic piano as close as possible to sounds of an acoustic piano. An example is Japanese Patent Laid-open No. 2014-59534, in which when a key is depressed in playing an acoustic piano, not only is a string striking sound produced, but also a keybed hitting sound is produced along with the depression of the key. In the field of electronic musical instruments such as electronic pianos, technologies for reproducing such keybed hitting sounds have been disclosed.

SUMMARY

According to an embodiment of the present invention, there is provided a sound output device comprising: a data storage device storing a first sound signal, a second sound signal, and a third sound signal; and a controller including a processor that implements instructions stored in a memory to execute a plurality of tasks, including: a sound signal output tasks that: reads the first and second sound signals or the first and third sound signals from the data storage device based on first information included in an instruction signal that instructs outputting of sound, the first information designating a magnitude of the sound; and outputs the read sound signals, wherein the instruction signal includes second information designating a pitch of the sound, and a pitch changing task that, in a case where the second information changes the pitch of the sound from a first pitch to a second pitch that is different from the first pitch: changes the pitch of the first sound signal in correspondence with a pitch difference between the first pitch and the second pitch; and changes the pitch of the second sound signal or the third sound signal by a pitch difference that is less than the change in the pitch of the first sound signal, or not changing the pitch of the second sound signal or the third sound signal.

According to an embodiment of the present invention, there is provided a non-transitory computer-readable storage medium storing a program executable by a computer to execute a method comprising: reading, from a data storage device storing a first sound signal, a second sound signal, and a third sound signal, the first and second sound signals or the first and the third sound signals based on first information included in an instruction signal that instructs outputting of sound, the first information designating a magnitude of the sound; and outputting the read sound signals, wherein the instruction signal includes second information designating a pitch of the sound, and in a case where the second information changes the pitch of the sound from a first pitch to a second pitch that is different from the first pitch: changing the pitch of the first sound signal in correspondence with a pitch difference between the first pitch and the second pitch; and changing the pitch of the second sound signal or the third sound signal by a pitch difference that is less than the change in the pitch of the first sound signal, or not changing the pitch of the second sound signal or the third sound signal.

BRIEF DESCRIPTION OF DRAWINGS

FIG. 11 is a table for explaining waveform data read from a hitting sound waveform memory by a hitting sound waveform readout unit according to the second embodiment of the present invention.

DESCRIPTION OF EMBODIMENTS

Figure 1:
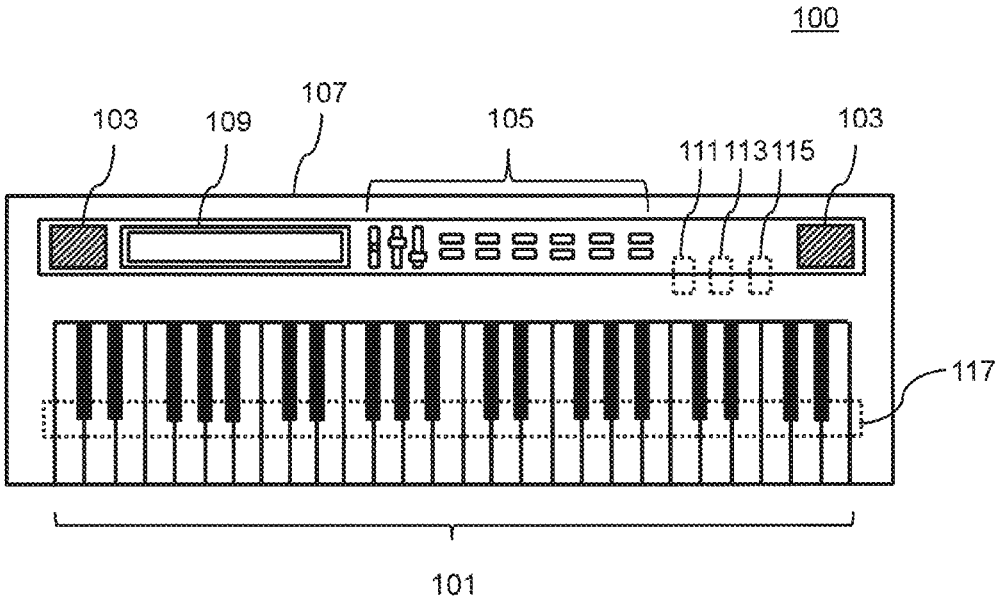
FIG. 1 is a diagram showing a configuration of a sound output device according to a first embodiment of the present invention.

Japanese Patent Laid-open No. 2014-59534 discloses a musical sound generating device that outputs a sound containing a keybed hitting sound that is produced by a key hitting a keybed when depressed. Reproduction of keybed hitting sounds in an electric piano makes it possible to reproduce sounds which are close to those of an acoustic piano. Therefore, in order to reproduce sounds which are closer to those of an acoustic piano, an electronic piano is required to reproduce actual keybed hitting sounds produced by an acoustic piano.

According to the present invention, it is possible to provide a sound output device that can more finely reproduce keybed hitting sounds of an acoustic piano.

In the following, an electronic keyboard musical instrument according to an embodiment of the present invention is described in detail with reference to the drawings. Embodiments to be described below are examples of embodiments of the present invention, and the present invention is not construed within the limitations of these embodiments. It should be noted that in the drawings that are referred to in the present embodiment, identical parts or parts having the same functions are given identical signs or similar signs (signs each formed simply by adding A, B, or the like to the end of a number) and a repeated description thereof may be omitted.

First Embodiment

[Configuration of Sound Output Device]

FIG. 1 is a diagram showing a configuration of a sound output device according to a first embodiment of the present invention. A sound output device 100 according to the present embodiment is an electronic keyboard musical instrument. The sound output device 100 is for example an electronic piano which is an example of an electronic musical instrument having a plurality of keys 101 as playing operators. A user's operation of a key 101 causes a sound to be produced from a speaker 103. The user can change types of sound (timbres) through the use of an operating unit 105. In this example, in producing sounds through the use of the timbre of a piano, the sound output device 100 can produce sounds which are close to those of an acoustic piano. In particular, the sound output device 100 can reproduce sounds of an acoustic piano in which keybed hitting sounds are contained. Each component of the sound output device 100 is described in detail below.

The sound output device 100 includes the plurality of keys 101 (playing operators). The plurality of keys 101 are rotatably supported by a housing 107. The housing 107 is provided with the speaker 103, the operating unit 105, and a display unit 109. The housing 107 has a control unit 111, a storage unit 113, a sound source 115, and a key behavior measuring unit 117 therein. The components provided in the housing 107 are connected to each other via a bus.

The control unit 111 includes an arithmetic processing circuit such as a CPU and a storage device such as a RAM or a ROM. The control unit 111 executes, through the CPU, a control program stored in the storage unit 113 and thereby allows the sound output device 100 to achieve various types of functions. The operating unit 105 is a device such an operation button, a touch sensor, a slider and outputs, to the control unit 111, a signal corresponding to an operation inputted. The display unit 109 displays a screen based on control by the control unit 111.

The storage unit 113 is a storage device such as a nonvolatile memory. The storage unit 113 has stored therein the control program that is executed by the control unit 111. Further, the storage unit 113 may have stored therein parameters, waveform data, and the like that are used in the sound source 115. The speaker 103 amplifies and outputs a sound signal output from the control unit 111 or the sound source 115 and thereby produces a sound corresponding to the sound signal. Although FIG. 1 shows a case where the sound output device 100 is provided with two speakers 103, the number of speakers with which the sound output device 100 is provided is not limited to two but needs only be one or more.

The key behavior measuring unit 117 measures the behavior of each of the plurality of keys 101 and outputs measurement data representing a measurement result. The key behavior measuring unit 117 outputs, as measurement data, information corresponding to a depressed key 101 and an amount of depression (amount of operation) of the key 101. For example, the key behavior measuring unit 117 is configured to, upon detecting at least one of first, second, and third amounts of depression of a key 101, output a detection signal corresponding the amount of depression. At this point in time, the information indicating the corresponding key 101 (for example, a key number) is included in the output detection signal, so that the depressed key 101 can be identified.

[Configuration of Key Assembly]

Figure 2:
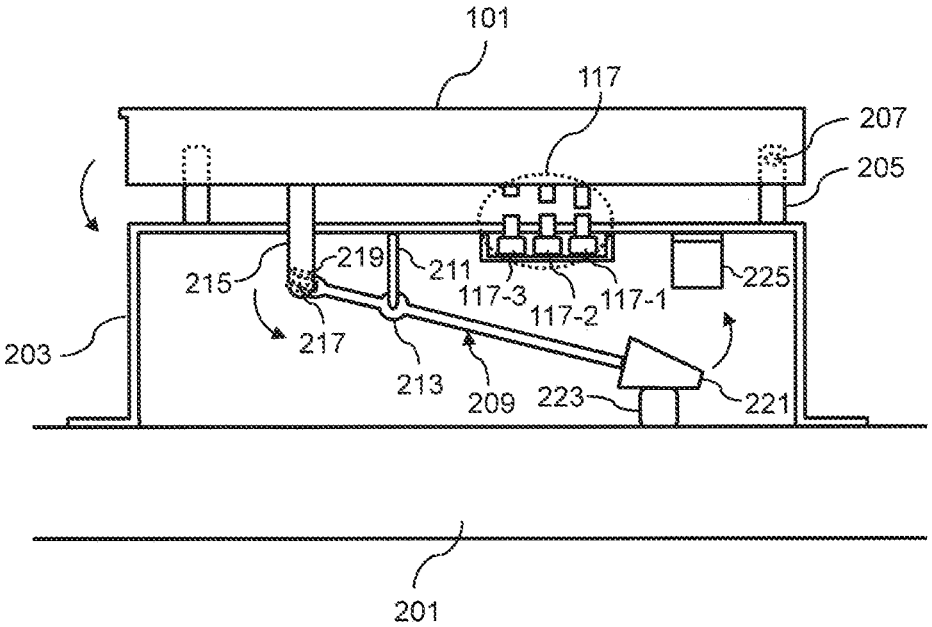
FIG. 2 is a diagram showing a mechanical structure (key assembly) linked with a key according to the first embodiment of the present invention.

FIG. 2 is a diagram showing a mechanical structure (key assembly) linked with a key 101 of the sound output device according to the first embodiment of the present invention. FIG. 2 gives a description by taking as an example a structure associated with a white key of the keys 101. A keybed 201 is a member that constitutes a part of the aforementioned housing 107. A frame 203 is fixed to the keybed 201. A key supporting member 205 projecting upward from the frame 203 is disposed on top of the frame 203. The key supporting member 205 supports the key 101 so that the key 101 can rotate on a spindle 207. A hammer supporting member 211 projecting downward from the frame 203 is provided. A hammer 209 is provided on the opposite side from the key 101 with respect to the frame 203. The hammer supporting member 211 supports the hammer 209 so that the hammer 209 can rotate on a spindle 213.

A hammer connecting part 215 projecting toward a lower position than the key 101 includes a coupling part 217 at a lower end thereof. The key connecting part 219 which is provided at one end of the hammer 209 and the coupling part 217 are slidably connected to each other. The hammer 209 includes a weight 221 on the opposite side from the key connecting part 219 with respect to the spindle 213. When the key 101 is not being operated, the weight 221 is placed on a lower limit stopper 223 by its own weight.

Meanwhile, depression of the key 101 causes the key connecting part 219 to move downward and causes the hammer 209 to rotate. Rotation of the hammer 209 causes the weight 221 to move upward. A collision of the weight 221 with an upper limit stopper 225 restricts the rotation of the hammer 209, so that the depression of the key 101 is stopped. A strong depression of the key 101 causes the weight 221 to hit the upper limit stopper 225, and a hitting sound is produced at that time. This hitting sound is transmitted to the keybed 201 though the frame 203 and emitted as a sound. In the configuration of FIG. 2, this sound is equivalent to a keybed hitting sound.

It should be noted that the key assembly is not limited to the structure shown in FIG. 2, provided it is a structure in which a hitting sound is produced by depressing the key 101. For example, the key assembly may have a structure in which the key 101 directly hits the keybed 201 when depressed. Alternatively, the key assembly may have a structure in which as shown in FIG. 2, depression of the key 101 causes a member that moves in tandem with the key 101 to hit the keybed 201 or a member connected to the keybed 201. The key assembly needs only be a structure in which depression of the key 101 causes a hitting sound to be produced by the occurrence of a collision in any part.

The key behavior measuring unit 117 (first sensor 117-1, second sensor 117-2, third sensor 117-3) is provided between the frame 203 and the key 101. Depressing the key 101 causes the first sensor 117-1 to output a first detection signal when the key 101 reaches the first amount of depression. Then, the second sensor 117-2 outputs a second detection signal when the key 101 reaches the second amount of depression. Furthermore, the third sensor 117-3 outputs a third detection signal when the key 101 reaches the third amount of depression. A velocity of depression of the key 101 can be calculated from temporal differences in output timing among the detection signals.

In the present embodiment, as an example, the control unit 111 calculates a first velocity of depression on the basis of the time from the output timing of the first detection signal to the output timing of the second detection signal and predetermined distances (here, a distance to the first amount of depression and a distance to the second amount of depression). Similarly, the control unit 111 calculates a second velocity of depression on the basis of the time from the output timing of the second detection signal to the output timing of the third detection signal and predetermined distances (here, the distance to the second amount of depression and a distance to the third amount of depression). The control unit 111 may calculate an acceleration of depression on the basis of the first velocity of depression and the second velocity of depression. Furthermore, the control unit 111 outputs a note-on signal Non to the sound source 115 upon detection of the third detection signal and, after having output the note-on signal Non and upon stoppage of the output of the first detection signal for the same key, outputs a note-off signal Noff to the sound source 115.

When a note-on signal Non is output, key number information Note (second information) and a velocity of depression Vel (first information) are output in association with the note-on signal Non. The velocity of depression Vel is the first velocity of depression or the second velocity of depression. The key number information Note is information for identifying the depressed key 101, and corresponds to information (pitch information) that designates the pitch of a sound.

On the other hand, when a note-off signal Noff is output, the key number information Note is output in association with the note-off signal Noff. It should be noted that in the following description, these pieces of information (operating information) which are output from the control unit 111 along with the operation of the key 101 are supplied to the sound source 115 as an instruction signal that gives an instruction to produce a sound. The instruction signal may include an acceleration of velocity Acc.

The sound source 115 generates a sound signal in accordance with an instruction signal, output from the control unit 111, that includes a note-on signal Non, a note-off signal Noff, key number information Note, a velocity of depression Vel, and an acceleration of velocity Acc, and outputs the sound signal to the speaker 103. A sound signal that the sound source 115 generates is obtained for each operation on the key 101. Moreover, a plurality of sound signals obtained by a plurality of key depressions are combined and output from the sound source 115.

[Configuration of Sound Source]

Figure 3:
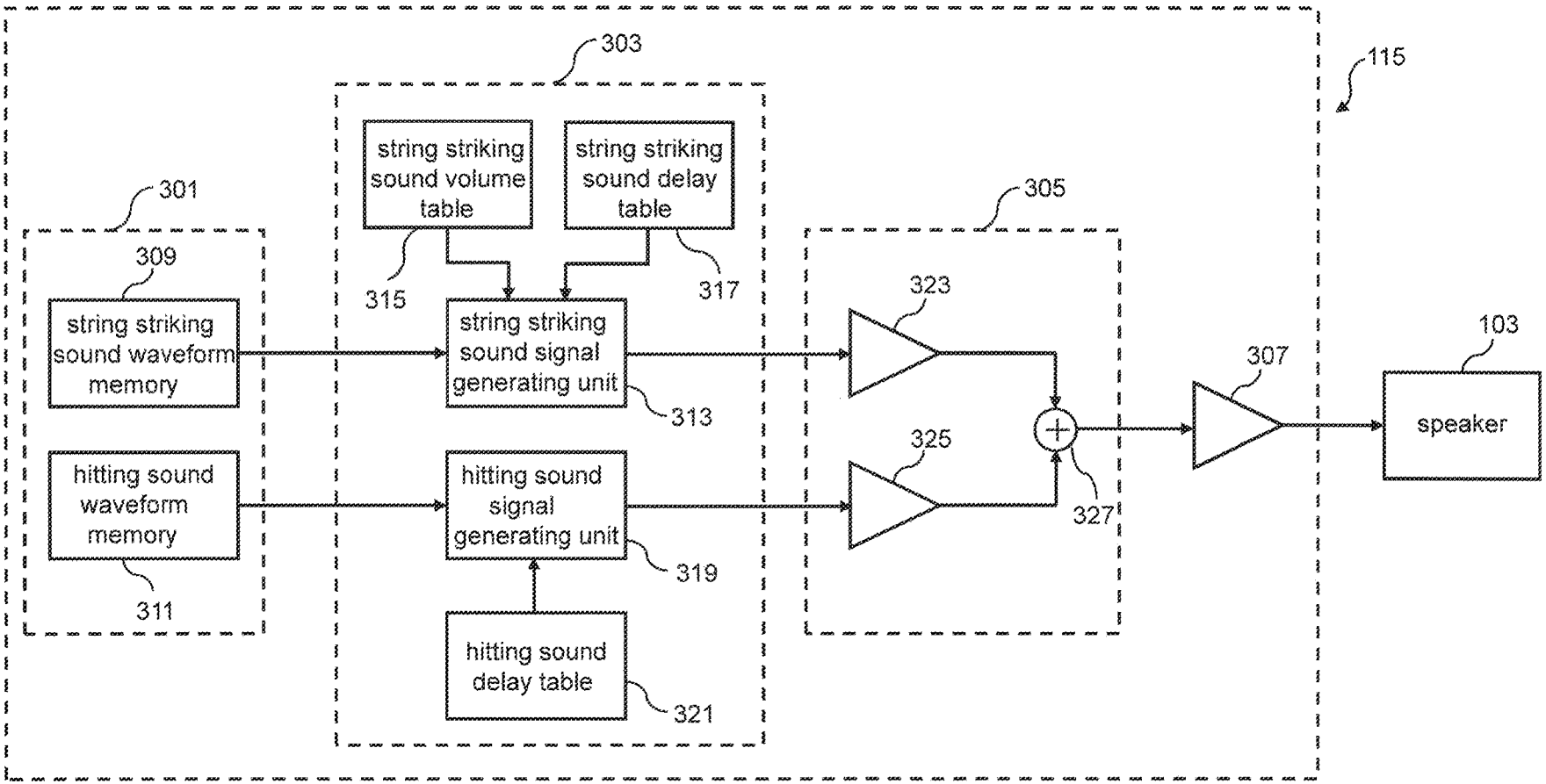
FIG. 3 is a block diagram showing a functional configuration of a sound source according to the first embodiment of the present invention.

FIG. 3 is a block diagram showing a functional configuration of a sound source according to the first embodiment of the present invention. The sound source 115 includes a data storage unit 301, a sound signal output unit 303, a speaker output synthesizing unit 305, and an amplifying unit 307.

The data storage unit 301 includes a string striking sound waveform memory 309 and a hitting sound waveform memory 311. The string striking sound waveform memory 309 has stored therein a sound signal (first sound signal) that is equivalent to a string striking sound of a piano. This sound signal is waveform data representing string striking sounds of a piano. This waveform data is waveform data obtained by sampling sounds of an acoustic piano (i.e. sounds produced by string striking entailed by key depression). In this example, waveform data of different pitches are stored in association with key numbers.

The hitting sound waveform memory 311 has stored therein at least two sound signals (namely a second sound signal and a third sound signal) that are equivalent to keybed hitting sounds of a piano. These sound signals are waveform data representing keybed hitting sounds of a piano. These waveform data are waveform data obtained by sampling, with varying velocities of key depression, keybed hitting sounds entailed by depression of keys of an acoustic piano. In the case of a change from a predetermined pitch (first pitch) to a different pitch (second pitch), the waveform data representing string striking sounds stored in the aforementioned string striking sound waveform memory 309 undergoes a change in pitch according to a pitch difference between the predetermined pitch and the different pitch. Meanwhile, the waveform data representing keybed hitting sounds undergoes no change in pitch or is less in pitch difference than the waveform data representing string striking sounds even in the case of a change from a predetermined pitch (first pitch) to a different pitch (second pitch).

The hitting sound waveform memory 311 has stored therein waveform data of at least two different keybed hitting sounds on the basis of velocities of key depression of the key 101. For example, the hitting sound waveform memory 311 may have stored therein waveform data of two different keybed hitting sounds. In this case, the hitting sound waveform memory 311 has first waveform data representing a keybed hitting sound produced in a case where the velocity of key depression Vel is lower than a predetermined threshold Vth and second waveform data representing a keybed hitting sound produced in a case where the velocity of key depression Vel is equal to or higher than the predetermined threshold Vth.

Figure 4:
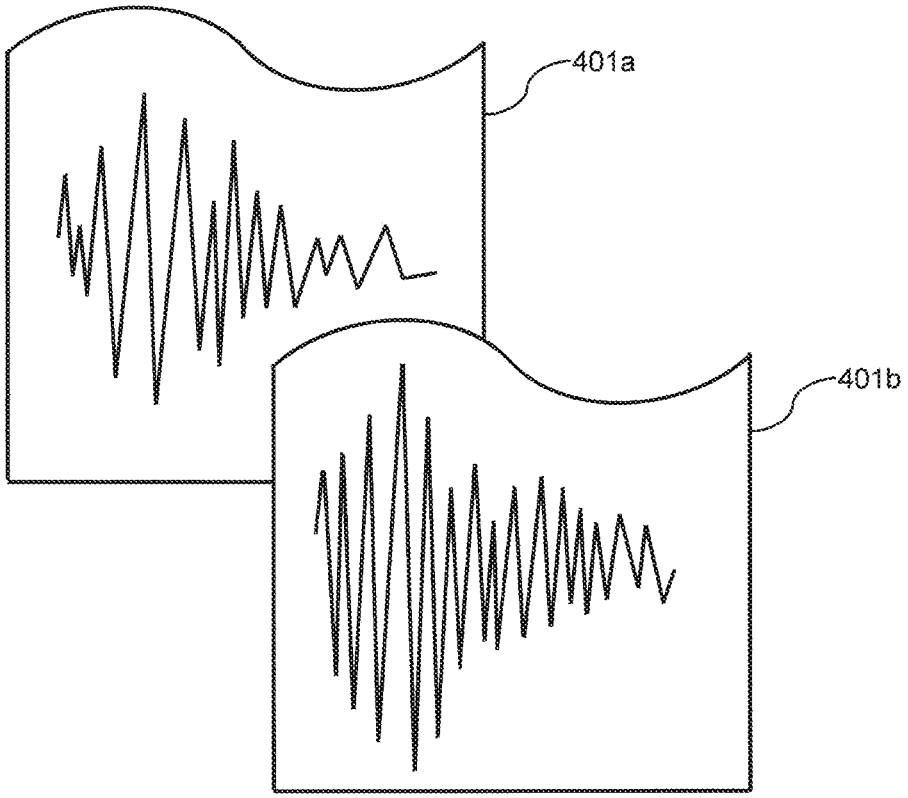
FIG. 4 is a diagram explaining waveform data of keybed hitting sounds according to the first embodiment of the present invention.

FIG. 4 is a diagram explaining waveform data of two difference keybed hitting sounds stored in the hitting sound waveform memory 311. FIG. 4 shows first waveform data 401*a* representing a keybed hitting sound produced in a case where the velocity of key depression Vel is lower than the predetermined threshold Vth and second waveform data 401*b* representing a keybed hitting sound produced in a case where the velocity of key depression Vel is equal to or higher than the predetermined threshold Vth. As shown in FIG. 4, the first waveform data 401*a* and the second waveform data 401*b* are different in waveform amplitude and wavelength from each other. The second waveform data 401*b* has a larger waveform amplitude and a larger number of peaks than the first waveform data 401*a*. This indicates that in a case where the velocity of key depression Vel is high, the sound volume of a keybed hitting sound is higher and the harmonics of a keybed hitting sound increase as compared with the case where the velocity of key depression Vel is low.

The sound signal output unit 303 outputs, on the basis of pitch information contained in an instruction signal that is supplied in response to depression of a key 101, a sound signal (string striking sound signal: first sound signal) that is equivalent to a string striking sound of a piano and a sound signal (hitting sound signal: second or third sound signal) that is equivalent to a keybed hitting sound of a piano. The sound signal output unit 303 includes a string striking sound signal generating unit 313 and a hitting sound signal generating unit 315.

Figure 5:
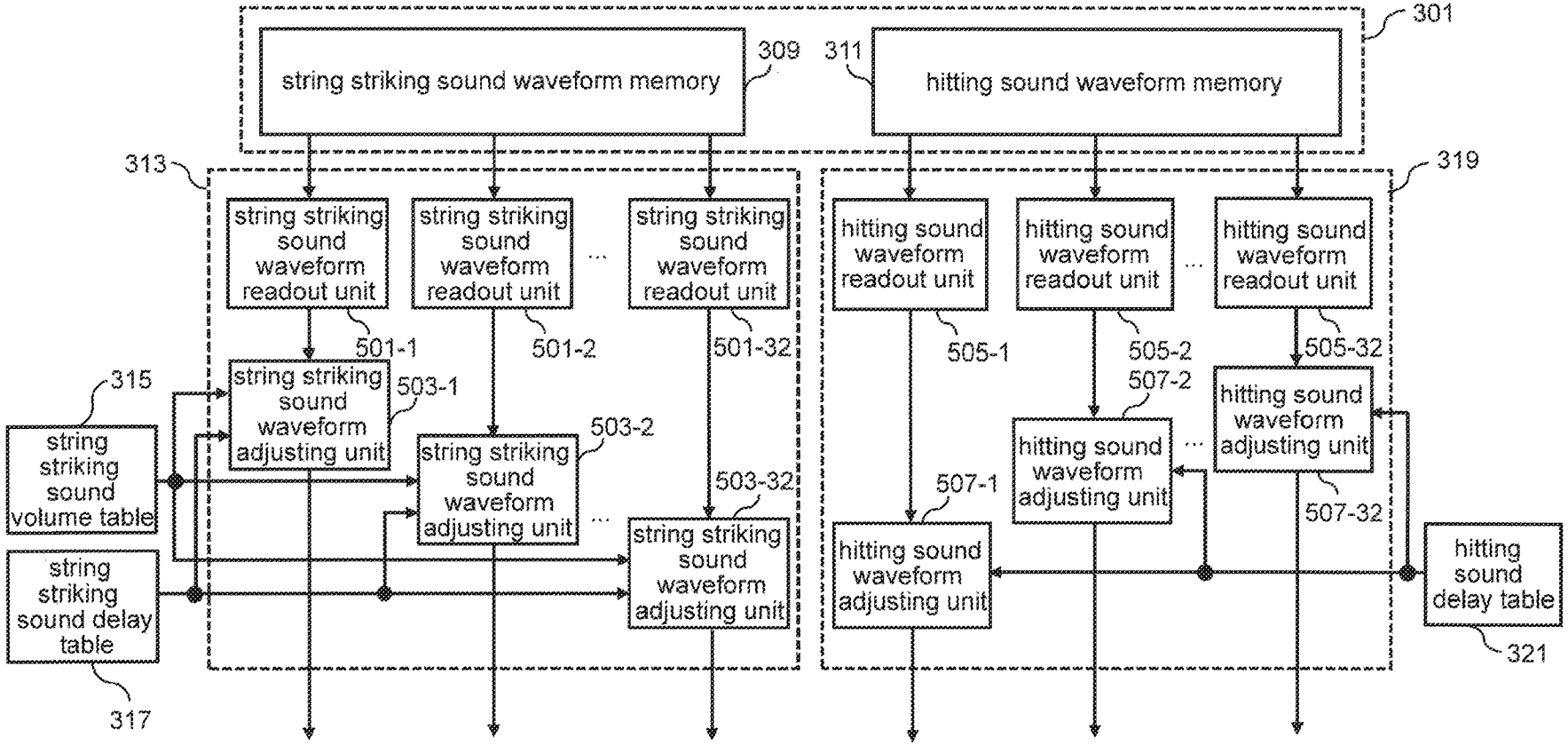
FIG. 5 is a block diagram showing functional configurations of a string striking sound signal generating unit and a hitting sound signal generating unit according to the first embodiment of the present invention.

The string striking sound signal generating unit 313 reads out waveform data from the string striking sound waveform memory 309 in accordance with an instruction signal, subjects the waveform data to envelope processing, which is for example controlled by ADSR parameters, and outputs the waveform data as a string striking sound signal. The string striking sound signal generating unit 313 outputs the string striking sound signal to the speaker output synthesizing unit 305. The hitting sound signal generating unit 319 reads out waveform data from the hitting sound waveform memory 311 in accordance with the instruction signal and outputs the waveform data as a hitting sound signal. The hitting sound signal generating unit 319 outputs the hitting sound signal to the speaker output synthesizing unit 305. FIG. 5 is a block diagram showing functional configurations of the string striking sound signal generating unit 313 and the hitting sound signal generating unit 315 according to the present embodiment. The string striking sound signal generating unit 313 and the hitting sound signal generating unit 315 are described in detail with reference to FIG. 5.

The string striking sound signal generating unit 313 includes a string striking sound waveform readout unit 501 (501-1, 501-2, . . . , **501-*m*) and a string striking sound waveform adjusting unit 503 (503-1, 503-2, . . . , 503-*m*). The sign "m" corresponds to the number of sounds that can be produced at the same time (i.e. the number of sound signals that can be generated at the same time) and, in the present embodiment, is 32. That is, the string striking sound signal generating unit 313** maintains produced sounds until the 32nd key depression and, upon the 33rd key depression, forcibly stops the sound signal corresponding to the first produced sound.

The string striking sound waveform readout unit 501 determines, on the basis of the key number information Note, the pitch of the waveform data to be read out. This causes the string striking sound waveform readout unit 501 to generate a string striking sound signal having a pitch corresponding to the key number information Note. The string striking sound waveform readout unit 501 outputs the string striking sound signal to the string striking sound waveform adjusting unit 503.

Figures 6, 7:
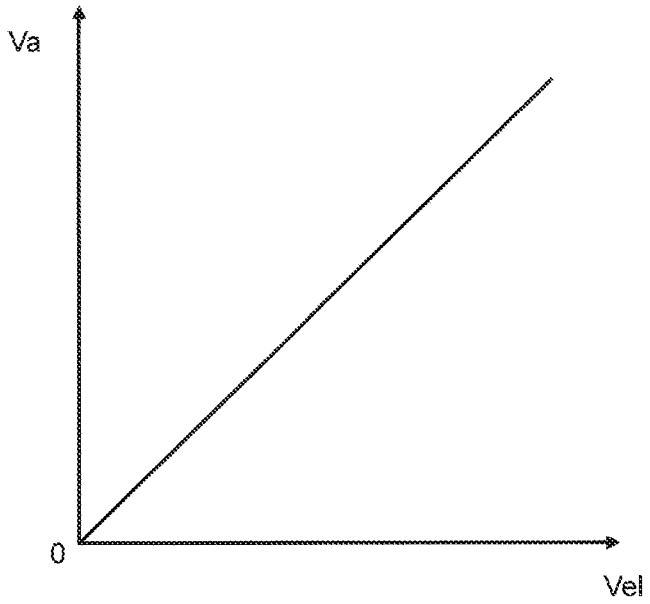
FIG. 6 is a diagram explaining a string striking sound volume table according to the first embodiment of the present invention.
FIG. 7 is a table for explaining waveform data read from a hitting sound waveform memory by a hitting sound waveform readout unit according to the first embodiment of the present invention.

The string striking sound waveform adjusting unit 503 performs envelope processing, which is for example controlled by ADSR parameters. The string striking sound waveform adjusting unit 503 determines the sound volume (maximum amplitude) of the string striking sound signal with reference to the string striking sound volume table 315. The string striking sound volume table 315 defines a relationship between a velocity of depression Vel and a string striking sound volume Va. FIG. 6 is a diagram explaining a string striking sound volume table according to the first embodiment of the present invention. FIG. 6 shows that the higher the velocity of depression Vel is, the higher the string striking sound volume Va is. Although, in FIG. 6, the velocity of depression Vel and the string striking sound volume Va are defined by a relationship that can be expressed by a linear function, this is not intended to impose any limitation. The relationship between the velocity of depression Vel and the string striking sound volume Va may be any relationship as long as the string striking sound volume Va can be specified with respect to the velocity of depression Vel.

The string striking sound waveform adjusting unit 503 determines a delay time from receiving of an instruction signal containing a note-on signal Non to outputting of a string striking sound signal with reference to the string striking sound delay table 317. The timing of generation (timing of production) of the string striking sound signal changes according to the delay time. The string striking sound delay table 317 will be described later.

The hitting sound signal generating unit 319 includes a hitting sound waveform readout unit 505 (505-1, 505-2, . . . , **505-*n*) and a hitting sound waveform adjusting unit 507 (507-1, 507-2, . . . , 507-*n*). The sign "n" corresponds to the number of sounds that can be produced at the same time (i.e. the number of sound signals that can be generated at the same time) and, in the present embodiment, is 32. That is, the hitting sound signal generating unit 319** maintains produced sounds until the 32nd key depression and, upon the 33rd key depression, forcibly stops the sound signal corresponding to the first produced sound.

The hitting sound waveform readout unit 505 reads out waveform data from the hitting sound waveform memory 309 on the basis of the velocity of depression Vel contained in the instruction signal. The velocity of depression Vel is information that designates the magnitude of a sound, i.e. the intensity of the sound. The hitting sound signal generating unit 319 reads out, depending on whether the velocity of depression Vel is lower than the predetermined threshold Vth or equal to or higher than the predetermined threshold Vth, either of the waveform data of two different keybed hitting sounds (i.e. the first waveform data and the second waveform data) stored in the hitting sound waveform memory 311.

FIG. 7 is a table for explaining waveform data that the hitting sound waveform readout unit 505 reads out from the hitting sound waveform memory 311 in the present embodiment. As shown in FIG. 7, in a case where the velocity of depression Vel is lower than the predetermined threshold Vth, the hitting sound waveform readout unit 505 reads out the first waveform data **401*a* shown in FIG. 4 and outputs it as a hitting sound signal. On the other hand, in a case where the velocity of depression Vel is equal to or higher than the predetermined threshold Vth, the hitting sound waveform readout unit 505 reads out the second waveform data 401*b* shown in FIG. 4** and outputs it as a hitting sound signal.

As mentioned above, the hitting sound waveform readout unit 505 generates a hitting sound signal on the basis of the velocity of depression Vel. The hitting sound waveform readout unit 505 outputs the hitting sound signal to the hitting sound waveform adjusting unit 507. Upon reading out waveform data for a predetermined period of time in accordance with an instruction signal, the hitting sound waveform readout unit 505 finishes generating a hitting sound signal in accordance with the instruction signal.

The hitting sound waveform adjusting unit 507 determines a delay time from receiving of an instruction signal representing a note-on signal Non to outputting of a hitting sound signal with reference to the hitting sound delay table 321. The timing of generation (timing of production) of the hitting sound signal changes according to the delay time. In the present embodiment, envelope processing on the hitting sound signal may or may not be performed. In a case where envelope processing is not performed, the hitting sound waveform memory 311 has stored therein waveform data of a predetermined period of time.

Figure 8:
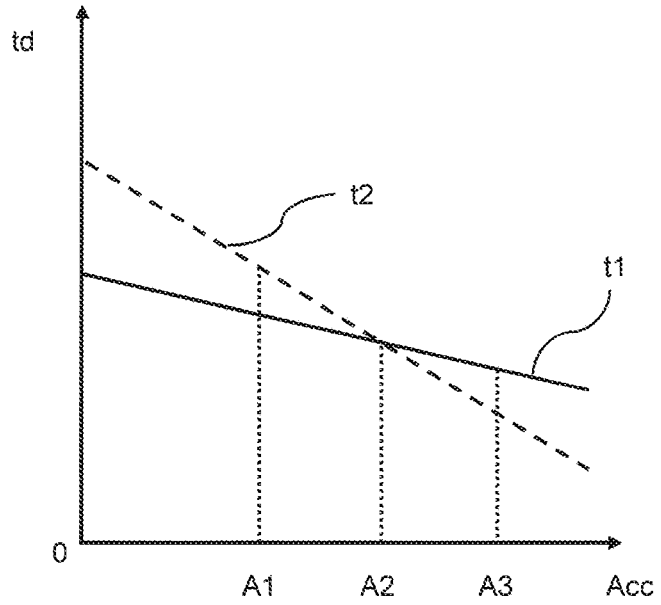
FIG. 8 is a diagram explaining a string striking sound delay table and a hitting sound delay table according to the first embodiment of the present invention.

FIG. 8 is a diagram explaining the string striking sound delay table 317 and the hitting sound delay table 321 according to the present embodiment. Both tables define a relationship between the acceleration of depression Acc and a delay time td. FIG. 8 shows the string striking sound delay table 317 and the hitting sound delay table 321 in contrast with each other. The string striking sound delay table 317 defines a relationship between the acceleration of depression Acc and the delay time td (string striking sound delay time t1). The hitting sound delay table 321 defines a relationship between the acceleration of depression Acc and the delay time td (hitting sound delay time t2). As shown in FIG. 7, in both the string striking sound delay table 317 and the hitting sound delay table 321, the higher the acceleration of depression Acc is, the shorter the delay time td (t1, t2) is.

In FIG. 8, when the acceleration of depression Acc is A2, the string striking sound delay time t1 and the hitting sound delay time t2 are equal to each other. When the acceleration of depression Acc is A1, which is smaller than A2, the hitting sound delay time t2 is longer than the string striking sound delay time t1. On the other hand, when the acceleration of depression Acc is A3, which is larger than A2, the hitting sound delay time t2 is shorter than the string striking sound delay time t1. Here, A2 may be "0". In this case, A1 takes on a negative value and indicates that the depressing is gradually decelerating. On the other hand, A3 takes on a positive value and indicates that the depressing is gradually accelerating. It should be noted that although, in FIG. 8, the acceleration of depression Acc and the delay time td are defined by a relationship that can be expressed by a linear function, this is not intended to impose any limitation. The relationship between the acceleration of depression Acc and the delay time td may be any relationship as long as the delay time td can be specified with respect to the acceleration of depression Acc. Further, the delay time td may be determined by using the velocity of depression Vel instead of the acceleration of depression Acc or using a combination of the velocity of depression Vel and the acceleration of depression Acc.

Figure 9:
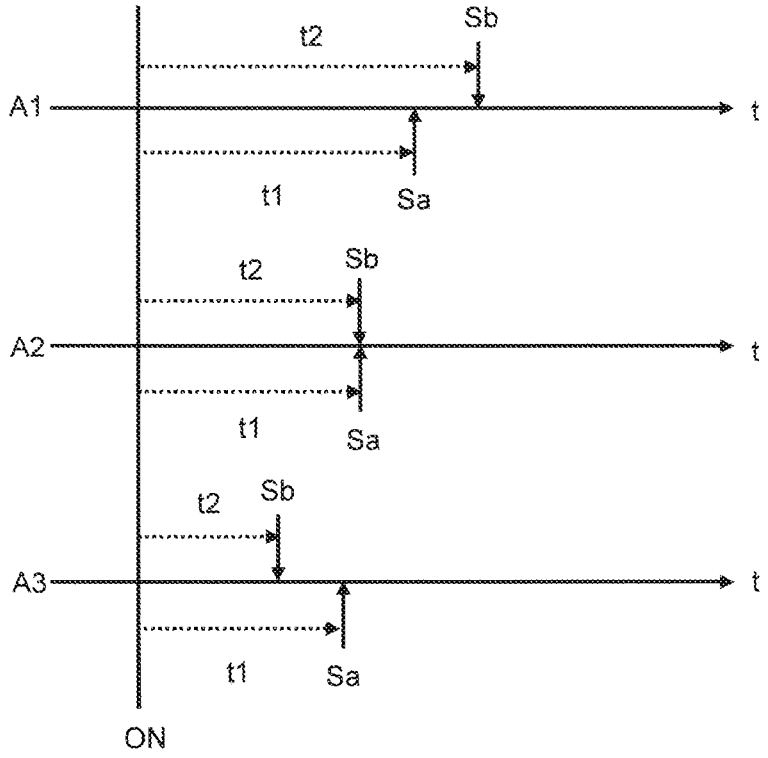
FIG. 9 is a diagram explaining timings of production of string striking sounds and hitting sounds with respect to note-on in the first embodiment of the present invention.

FIG. 9 is a diagram explaining timings of production of string striking sounds and hitting sounds with respect to note-on according to the present embodiment. A1, A2, and A3 in FIG. 9 correspond to values of the accelerations of depression A1, A2, and A3 in FIG. 8. That is, the relationship among the accelerations of depression is defined as A1<A2<A3. In FIG. 9, it shows signals at times along the horizontal axis. The sign "ON" in FIG. 9 denotes a timing of receiving of an instruction signal containing a note-on signal Non. The sign "Sa" denotes a timing of start of generation of a string striking sound signal, and the sign "Sb" denotes a timing of start of generation of a hitting sound signal. Accordingly, the string striking sound delay time t1 corresponds to the time from "ON" to "Sa". The hitting sound delay time t2 corresponds to the time from "ON" to "Sb". As shown in FIG. 8, the higher the acceleration of depression Acc is, the delay of the timings of generation of both the string striking sound signal and the hitting sound signal from the note-on decreases.

Furthermore, the hitting sound signal is larger in proportion of change in timing of generation due to a difference in acceleration of depression Acc than the string striking sound signal. Accordingly, a relative relationship between the timing of generation of the string striking sound signal and the timing of generation of the hitting sound signal changes according to the acceleration of depression.

The speaker output synthesizing unit 305 receives a string striking sound signal and a hitting sound signal from the sound signal output unit 303. The speaker output synthesizing unit 305 includes amplifying units 323 and 325 and a synthesizing unit 327. The amplifying unit 323 amplifies, by a predetermined amplification factor, a string striking sound signal output from the string striking sound signal generating unit 313. The amplifying unit 325 amplifies, by a predetermined amplification factor, a hitting sound signal output from the hitting sound signal generating unit 319. The synthesizing unit 327 synthesize s by addition the string striking sound signal amplified by the amplifying unit 323 and the hitting sound signal amplified by the amplifying unit 325 and outputs a synthesized signal. These configurations cause the speaker output synthesizing unit 305 to output a speaker sound signal made by synthesizing the string striking sound signal and the hitting sound signal at a predetermined sound volume ratio.

The amplifying unit 307 is set at a predetermined amplification factor. The amplifying unit 307 amplifies, by the predetermined amplification factor, the speaker sound signal output from the speaker output synthesizing unit 305. The setting of this amplification factor can be changed by operating a volume knob or the like of the operating unit 105. The amplifying unit 307 outputs, to the speaker 103, the speaker sound signal amplified by the predetermined amplification factor.

In general, in an acoustic piano, a keybed hitting sound that is produced in a case where a key is depressed hard, i.e. a case where the velocity of key depression is high, and a keybed hitting sound that is produced in a case where a key is gently depressed, i.e. a case where the velocity of key depression is low, are different from each other. In the present embodiment, waveform data representing two different keybed hitting sounds are stored in the hitting sound waveform memory 311. The waveform data representing two keybed hitting sounds stored in the hitting sound waveform memory 311 are first waveform data representing a keybed hitting sound produced in a case where the velocity of key depression Vel is lower than the predetermined threshold Vth and second waveform data representing a keybed hitting sound produced in a case where the velocity of key depression Vel is equal to or higher than the predetermined threshold Vth. The hitting sound signal generating unit 315 reads out either the first waveform data or the second waveform data from the hitting sound waveform memory 311 on the basis of the velocity of key depression Vel and outputs the waveform data as a hitting sound signal. By thus selecting waveform data representing a keybed hitting sound according to the velocity of key depression and outputting the selected waveform data, the sound output device of the present invention can more finely reproduce keybed hitting sounds of an acoustic piano.

In the present embodiment, an example is described in which waveform data representing two different keybed hitting sounds are stored in the hitting sound waveform memory 311 on the basis of the velocity of key depression. However, the number of waveform data representing keybed hitting sounds that are stored in the hitting sound waveform memory 311 is not limited to two. For example, the hitting sound waveform memory 311 may store waveform data representing three or more keybed hitting sounds on the basis of the velocity of key depression.

In the present embodiment, the data storage unit 301, which includes the string striking sound waveform memory 309 and the hitting sound waveform memory 311, is included in the sound source 115. Alternatively, the string striking sound waveform memory 309 and the hitting sound waveform memory 311 may be included in the storage unit 113.

Second Embodiment

The first embodiment has described an example in which waveform data representing at least two different keybed hitting sounds on the basis of the velocity of key depression are stored in the hitting sound waveform memory. A second embodiment describes an example in which waveform data further representing different keybed hitting sounds for each range are stored in the hitting sound waveform memory.

A sound output device according to the second embodiment of the present invention is substantially identical in configuration to the sound output device 100 according to the aforementioned first embodiment except for the difference in the number of waveform data representing keybed hitting sounds stored in the hitting sound waveform memory. Therefore, a repeated description is omitted.

Figure 10:
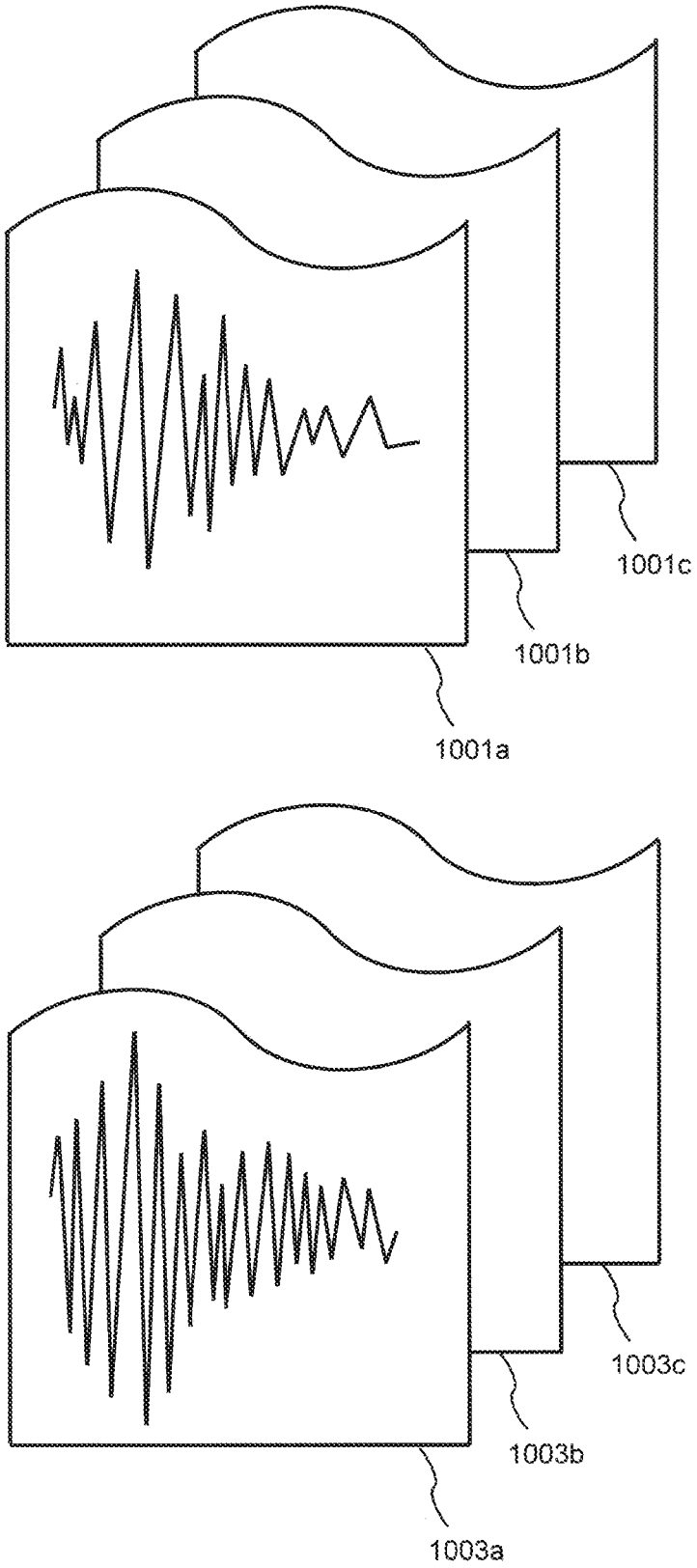
FIG. 10 is a diagram explaining waveform data of keybed hitting sounds according to a second embodiment of the present invention.

FIG. 10 is a diagram explaining waveform data of six different keybed hitting sounds stored in the hitting sound waveform memory of the sound output device according to the second embodiment of the present invention. FIG. 10 shows first waveform data 1001*a*, second waveform data 1001*b*, and third waveform data 1001*c*, which represent keybed hitting sounds produced in a case where the velocity of key depression Vel is lower than the predetermined threshold Vth, and fourth waveform data 1003*a*, fifth waveform data 1003*b*, and sixth waveform data 1003*c*, which represent keybed hitting sounds produced in a case where the velocity of key depression Vel is equal to or higher than the predetermined threshold Vth.

The first waveform data 1001*a* is lower-range waveform data generated in a case where the velocity of key depression Vel is lower than the predetermined threshold Vth. The second waveform data 1001*b* is middle-range waveform data generated in a case where the velocity of key depression Vel is lower than the predetermined threshold Vth. The third waveform data 1001*c* is higher-range waveform data generated in a case where the velocity of key depression Vel is lower than the predetermined threshold Vth. Similarly, the fourth waveform data 1003*a* is lower-range waveform data generated in a case where the velocity of key depression Vel is equal to or higher than the predetermined threshold Vth. The fifth waveform data 1003*b* is middle-range waveform data generated in a case where the velocity of key depression Vel is equal to or higher than the predetermined threshold Vth. The sixth waveform data 1003*c* is higher-range waveform data generated in a case where the velocity of key depression Vel is equal to or higher than the predetermined threshold Vth. These first to sixth waveform data are waveform data obtained by sampling, with varying velocities of key depression and positions of key depression, keybed hitting sounds caused by depression of keys of an acoustic piano.

As mentioned above, in general, in an acoustic piano, a keybed hitting sound that is produced in a case where a key has been depressed hard, i.e. a case where the velocity of key depression is high, and a keybed hitting sound that is produced in a case where a key has been gently depressed, i.e. a case where the velocity of key depression is low, are different from each other. Furthermore, in an acoustic piano, different keybed hitting sounds are produced in a case where positions of key depression are different; that is, a keybed hitting sound that is produced in a case where a lower-range key is depressed, a keybed hitting sound that is produced in a case where a middle-range key is depressed, and a keybed hitting sound that is produced in a case where a higher-range key is depressed are different from one another. This is because paths through which keybed hitting sounds are transmitted from keybeds to a soundboard vary according to the positions of production of the keybed hitting sounds. It should be noted the lower range, the middle range, and the higher range are arbitrarily set in advance.

In the present embodiment, the hitting sound signal generating unit reads out waveform data from the hitting sound waveform memory in accordance with an instruction signal and outputs the waveform data as a hitting sound signal. At this point in time, the hitting sound waveform readout unit of the hitting sound signal generating unit reads out any one of the pieces of waveform data representing six different keybed hitting sounds stored in the hitting sound waveform memory on the basis of the velocity of key depression Vel and the key number information Note that are contained in the instruction signal. FIG. 11 is a table for explaining waveform data that the hitting sound waveform readout unit reads out from the hitting sound waveform memory in the present embodiment. For example, in a case where the velocity of key depression Vel contained in instruction information is lower than the predetermined threshold Vth and the key number belongs to the lower range, the hitting sound waveform readout unit reads out the first waveform data 1001*a*, as shown in FIG. 11. On the other hand, in a case where the velocity of key depression Vel contained in the instruction information is equal to or higher than the predetermined threshold Vth and the key number belongs to the middle range, the hitting sound waveform readout unit reads out the fifth waveform data 1003*b*.

By thus selecting waveform data representing a keybed hitting sound according to the velocity of key depression Vel and the key number information Note and reading out the waveform data, the sound output device of the present embodiment can more finely reproduce keybed hitting sounds of an acoustic piano.

It should be noted that although the present embodiment is illustrated a case where waveform data of six different keybed hitting sounds are stored in the hitting sound waveform memory, the number of waveform data that are stored in the hitting sound waveform memory is not limited to six. The hitting sound waveform memory can store waveform data corresponding to the number of ranges that is arbitrarily set.

In the embodiment described above, waveform data of a keybed hitting sound is selected on the basis of the velocity of key depression Vel. However, waveform data of a keybed hitting sound may be selected on the basis of other information as well as the velocity of key depression Vel or on the basis of a keybed hitting velocity estimated by the combined use of those pieces of information. The other information here may be information indicating an action related to a playing operation or may be the action of some components (related to a change in a keybed hitting sound) of an action that operates on the basis of a playing operation.

What is claimed is:

1. A sound output device comprising:

a data storage device storing a first sound signal, a second sound signal, and a third sound signal; and a controller including a processor that implements instructions stored in a memory to execute a plurality of tasks, including:

a sound signal output task that:

reads the first and second sound signals or the first and third sound signals from the data storage device based on first information included in an instruction signal that instructs outputting of sound, the first information designating a magnitude of the sound; and outputs the read sound signals, wherein the instruction signal includes second information designating a pitch of the sound, and a pitch changing task that, in a case where the second information changes the pitch of the sound from a first pitch to a second pitch that is different from the first pitch:

changes the pitch of the first sound signal in correspondence with a pitch difference between the first pitch and the second pitch; and changes the pitch of the second sound signal or the third sound signal by a pitch difference that is less than the change in the pitch of the first sound signal, or not changing the pitch of the second sound signal or the third sound signal.

2. The sound output device according to claim 1, wherein the second sound signal and the third sound signal are different in signal waveform from each other.

3. The sound output device according to claim 1, wherein the data storage device stores a plurality of ones of the second sound signal and a plurality of ones of the third sound signal according to the pitch of the first sound signal.

4. The sound output device according to claim 3, wherein the sound signal output task selects one of the plurality of second sound signals or one of the plurality of third sound signals based on the second information of the instruction signal.

5. The sound output device according to claim 1, wherein the plurality of tasks include a timing changing task that changes a relative relationship between a timing of generation of the first sound signal and a timing of generation of the second sound signal, or a relative relationship between the timing of generation of the first sound signal and the timing of generation of the third sound signal based on the first information of the instruction signal.

6. A non-transitory computer-readable storage medium storing a program executable by a computer to execute a method comprising:

reading, from a data storage device storing a first sound signal, a second sound signal, and a third sound signal, the first and second sound signals or the first and the third sound signals based on first information included in an instruction signal that instructs outputting of sound, the first information designating a magnitude of the sound; and outputting the read sound signals, wherein the instruction signal includes second information designating a pitch of the sound, and in a case where the second information changes the pitch of the sound from a first pitch to a second pitch that is different from the first pitch:

changing the pitch of the first sound signal in correspondence with a pitch difference between the first pitch and the second pitch; and changing the pitch of the second sound signal or the third sound signal by a pitch difference that is less than the change in the pitch of the first sound signal, or not changing the pitch of the second sound signal or the third sound signal.

7. The non-transitory computer-readable storage medium according to claim 6, wherein the second sound signal and the third sound signal are different in signal waveform from each other.

8. The non-transitory computer-readable storage medium according to claim 6, wherein the data storage device stores a plurality of ones of the second sound signal and a plurality of ones of the third sound signal according to the pitch of the first sound signal.

9. The non-transitory computer-readable storage medium according to claim 8, wherein one of the plurality of second sound signals or one of the plurality of third sound signals is selected based on the second information of the instruction signal.

10. The non-transitory computer-readable storage medium according to claim 6, wherein a relative relationship between a timing of generation of the first sound signal and a timing of generation of the second sound signal or a relative relationship between the timing of generation of the first sound signal and the timing of generation of the third sound signal is changed based on the first information of the instruction signal.

* * * * *